US010016005B2

(12) United States Patent
Thomas

(10) Patent No.: US 10,016,005 B2
(45) Date of Patent: Jul. 10, 2018

(54) HAIR EXTENSION DEVICE

(71) Applicant: Infinity Grip, LLC, Dallas, TX (US)

(72) Inventor: Phillip Thomas, Dallas, TX (US)

(73) Assignee: Infinity Grip LLC, Dallas, TX (US)

( * ) Notice: Subject to any disclaimer, the term of this patent is extended or adjusted under 35 U.S.C. 154(b) by 187 days.

(21) Appl. No.: 14/997,228

(22) Filed: Jan. 15, 2016

(65) Prior Publication Data

US 2017/0202289 A1 Jul. 20, 2017

(51) Int. Cl.
*A41G 3/00* (2006.01)
*A41G 5/00* (2006.01)

(52) U.S. Cl.
CPC ..... *A41G 5/006* (2013.01); *A41G 5/0073* (2013.01)

(58) Field of Classification Search
CPC ..... A41G 5/00; A41G 5/006; A41G 5/0073; A41G 5/004; A41G 5/0046; A41G 5/008
See application file for complete search history.

(56) References Cited

U.S. PATENT DOCUMENTS

| | | | | |
|---|---|---|---|---|
| 3,192,589 | A | 7/1965 | Pearson | |
| 5,015,805 | A | 5/1991 | Beckloff et al. | |
| 5,031,312 | A | 7/1991 | Culbertson et al. | |
| 5,077,870 | A | 1/1992 | Melbye et al. | |
| 5,722,434 | A * | 3/1998 | Walker | A41G 5/0073 132/201 |
| 7,854,233 | B2 | 12/2010 | Freelove | |
| 8,434,500 | B2 * | 5/2013 | Alex | A41G 5/004 132/201 |
| 2008/0190442 | A1 | 8/2008 | Kwak | |
| 2010/0170524 | A1 * | 7/2010 | Kimura | A41G 5/006 132/54 |
| 2011/0061674 | A1 * | 3/2011 | Oeffinger | A41G 5/0073 132/275 |
| 2013/0125913 | A1 * | 5/2013 | Ellery | A41G 5/002 132/201 |

* cited by examiner

*Primary Examiner* — Rachel Steitz

(57) ABSTRACT

A hair extension device is provided having an attachment portion and a weft portion. The attachment portion has a front side having headed studs extending therefrom. One or more wefts of filaments are attached to the backside of the attachment portion.

3 Claims, 6 Drawing Sheets

HAIR EXTENSION DEVICE

TECHNICAL FIELD

The invention is related to hair extensions and hair fasteners incorporating, for example, wefts of hair, taped wefts, glued wefts or stitched wefts.

BACKGROUND

Extensions or wefts of hair are multiple filaments or strands of hair (real or synthetic) coupled together in a unit. The strands of hair form a linear assemblage such that the individual hairs are located side by side and parallel to each other.

Extensions are used for cosmetic purposes wherein they are attached to the head or the hair of a human so as to be interspersed with the naturally growing hair of the human. Extensions are commonly used to stylize a person's hair by extending the length of hair or by increasing the volume of hair.

Extensions are made with wefts of hair comprising either natural human hair, animal hair (such as horse hair), and/or synthetic hair. Extensions are commercially available in a variety of colors and textures.

It is important to be able to secure one or more extensions to the hair or the head of a person with a minimum of discomfort. It is also important that the extensions stay fixed or in place while being worn by the wearer. Prior art methods of attaching hair extensions involved the use of adhesives, tape adhesives or a technique known as weaving. When adhesives are used, the extensions are glued to the person's naturally growing hair. When tape adhesives are used, the extensions are taped to sections of the person's naturally growing hair. One type of weaving involves first weaving a braid of the naturally growing hair, then stitching an extension to the braid with needle and thread. All of these prior art techniques are unsatisfactory in that they attach the extensions in manners that are semi-permanent, yet short lived. That is, as naturally growing hair grows out after a few weeks, the extensions must be removed and replaced. Removal and replacement of these semi-permanent extensions is a time consuming and expensive task. Further, the removed extensions are not reusable. Thus, often new replacement extensions must be color and texture matched before using them.

What is needed is a less permanent, yet secure hair extension device and method of installing extensions that allows for easy attachment to and removal from a person's hair. It would also be advantageous if the hair extensions were reusable in order to allow for easier and less expensive readjustments or repositioning of the hair extension.

SUMMARY

Various embodiments of the present hair extension device provide a hair extension device that can be installed in a wearer's hair for a few hours or a few weeks. Embodiments are easily attached to a wearer's hear and then easily removed or adjusted and then reattached. As such, various embodiments are reusable and with minor readjustments may be worn for extended periods of time.

An embodiment provides a hair extension device that has a resilient base with a back surface and a front surface. The front surface has an array of upstanding headed studs distributed across all or at least a portion of the front surface of the resilient base. Each headed stud has a stem portion and a head portion. The embodiment also has a first weft of hair that is attached to and is parallel with the back surface of the resilient base. The first weft of hair has a length that extends beyond a lower edge of the resilient base to a first distal end.

In various embodiments, there is also a first seam that extends across a width of the first weft of hair. The first seam is configured to hold strands or filaments of hair of the first weft of hair in parallel positions relative to each other. The first seam may be attached to the back surface of the resilient base by an adhesive, glue-adhesive, ultrasonic welding, clips, staples, or other technique.

In yet other embodiments, the hair extension device may further include a second weft of hair that has a length extending to a distal end of this second weft of hair. The second weft of hair is attached to either the back surface of the base or to the back side of the first weft of hair. The distal end of this second weft of hair is located beyond the bottom edge of the resilient base. The second weft of hair also has a seam extending across the width of the second weft of hair. This seam is configured to hold strands or filaments of hair of the second weft of hair in parallel positions relative to each other.

In other embodiments, the hair extension device comprises second weft of hair that has a second length that extends to a distal end of the second weft of hair that is located beyond the edge of a top edge of the resilient base. This second weft may have a second seam across the width of the second weft of hair that holds the strands of hair or filaments in parallel positions relative to each other and attaches the second weft of hair to the back surface of the base or to the seam of the first weft of hair.

In some embodiments, the headed studs of the hair extension device are distributed such that the spacing between them is between 0.5 mm and 3 mm so that hair strands of a wearer can fit between the headed studs and become entwined, woven between, entangled and wrapped about the headed studs.

In yet other embodiments the first weft of hair has the seam located such that a portion of hair extends in opposing directions from the seam, which is attached to the back surface of the base, such that the part of the weft of hair extends downward past a lower edge of the base and the other part of the weft of hair extends upward past the upper edge of the base.

Another embodiment of the hair extension device comprises an attachment portion and a weft portion. The attachment portion includes a base having a back surface and a front surface. On the front surface of the base is a plurality of upstanding headed studs spaced apart from each other in an array and distributed across at least a portion of the front surface of the base. Each of the upstanding headed studs has a stem portion have a bottom end integral with the front surface and a head portion at the top end of the stem portion. The weft portion comprises a first weft of filaments attached, proximate to a first end of the first weft of filaments, to the back surface of the base such that the first weft of filaments are parallel with the back surface proximate to the first end. The first weft of filaments extends from behind the back surface past a lower edge of the base and has a first length.

In some embodiments of the hair extension device, the first weft of filaments comprises a seam configured to hold the filaments of the first weft of filaments together and wherein the first weft of filaments is attached to the back surface of the base at the seam.

In some embodiments the seam comprises an adhesive or other type of glue. The adhesive can be used to attach the weft of filaments to the back surface of the base. In other embodiments the first weft of filaments are attached to the base by ultrasonic welding.

In some embodiments of the hair extension device each head portion has an upper surface and a lower surface wherein the lower surface is one of a sloped or concave surface about the backside of the headed portion and between the upper surface of the head portion and the top end of the stem portion.

In some embodiments, the weft portion further comprises a second weft of filaments that are attached proximate to a first end of the second weft of filaments to the back surface of the base or to the first weft of filaments behind the back surface of the base. This second weft of filaments extends from behind the back surface past the lower edge of the base to a second end of the second weft of hair.

In other embodiments, the weft portion further comprises a second weft of filaments that are attached proximate to a first end of the second weft of filaments to the back surface of the base or to the first weft of filaments behind the back surface of the base. This second weft of filaments extends from behind the back surface past the upper edge of the base to a second end of the second weft of hair. Here the second weft of filaments extends in a direction opposite from the first weft of filaments.

In various embodiments the head portion, regardless of whether its shape is round, oval, diamond shaped, eye shaped, triangular or other geometric shape, as viewed from in front of the front surface of the base, is centered on the stem portion.

BRIEF DESCRIPTION OF THE DRAWINGS

For a more complete understanding, reference is now made to the following description taken in conjunction with the accompanying Drawings in which.

DETAILED DESCRIPTION

Figure 1:
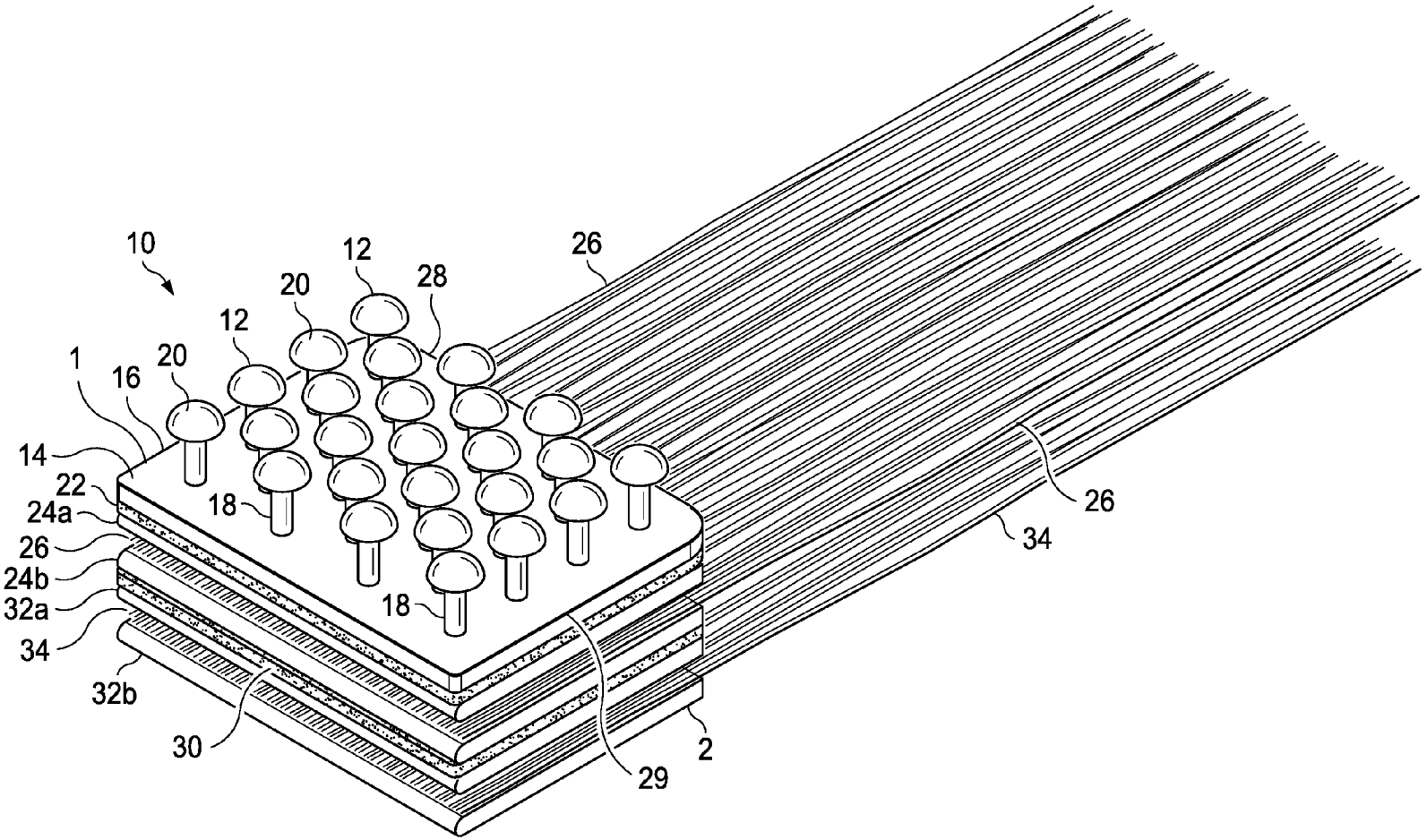
FIG. 1 is a perspective view of a hair extension device in accordance with an embodiment of the invention.

Referring now to the drawings, wherein like reference numbers are used herein to designate like elements throughout, the various views and embodiments of the hair extension device are illustrated and described. Other possible embodiments are also described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Embodiments of the present invention provide a hair extension device that is releasably attached to the hair on the head of a wearer and allows for the appearance of having additional, fuller or longer hair. Hair extension embodiments are designed to affix to the hair on the head of a wearer without the need for gluing hair extensions to the to the user's natural hair, gluing the device onto the scalp of the user, attaching the hair wefts with tape, or using supplemental hair clips.

FIG. 1 shows a perspective view of a hair extension device 10. The hair extension may have two main portions being the attachment portion 1 and the weft portion 2. The hair extension device has a plurality of headed studs 12 in staggered rows. The headed studs 12 extend from a front surface 14 of a thin resilient base 16. The headed studs 12 and base 16 are part of the attachment portion 1. The thickness of the base 16 may be between about 1 mm and about 3 mm thick. Each headed stud 12 has a stem portion 18 and a cap portion 20. The headed studs 12 are separated by a distance that allows hair filaments or strands to fit and fall between the head portions 20 and in order to become tightly entwined and entangled about one or more stem portions 18 forming what the inventor refers to as a Felini grip, which holds the hair extension device in a removably secured manner when installed in accordance with methods discussed herein. The flexible and resilient base 16 allows the distance between the headed studs 12 to be increased when the base 16 is flexed. Each of the headed studs may also have an inherent "spring" for moving so as to open or increase the distance between an adjacent headed stud and springing back to its original position, which further allows hair strands to move between the headed studs 12.

This invention and most parts of this invention may be compositely made of metal, textiles, real hair, synthetic hair, elastomers and other materials. In some embodiments, the substrate or base and the headed studs 12 are made of non-metallic synthetic organic plastic materials and other variations and derivations thereof, including but not limited to, polyethylene, vinyl chloride, ABS, thermoplastics, acrylic Plexiglas, butyrate, Cellulose acetate, flexible PVC, and polypropylene. As there is a continuing development of polymeric materials, it is conceivable to assume that other plastics existing today or in the future may be equally suitable, as long as they possess thermo-plasticity for formability; resiliency to permit distortion of shape and strain as required in separable headed stud movement; resistance to water, soaps and detergents; non brittleness at low outdoor temperatures; and retentivity of molded shape in hot to boiling water. Determining suitability of a material for the base 16 and headed studs 12 does not require experimenting of and inventive character, as routine tests under simulated practical conditions will suffice.

In various embodiments, the stem portions 18 all have a same predetermined length L of between 2 to 6 mm and a diameter or cross-sectional width of 0.5 to 1.5 mm. In other embodiments, the length L of the stem portions 18 may vary in a staggered or random manner (not specifically shown) between two or three predetermined lengths.

In various embodiments, the weft portion 2 comprises one or more wefts of filaments attached to the back surface of the base.

Adjacent to a back surface of the base 16 is an adhesive distributed and configured to hold a seam 24*a* (and in some embodiments also a seam 24*b*) of a hair weft 26 firmly in place. The hair weft 26 incorporated into embodiments of the invention may be a weft of hair, a taped weft, a stitched weft, a glued weft or other type of weft having a textile seam, adhesive seam, or other type of seam configured to hold the strands of artificial or real hair in parallel positions relative to each other. In some embodiments a seam is not necessary. The artificial or real hair weft without a seam (hereinafter referred to as a "weft of hair") 26 is held by the taped or stitched seam 24 (i.e. 24*a* and/or 24*b*). In this embodiment, the weft of hair 26 begins behind the base 16 and extends out from under a bottom edge 28 of the base 16. The weft of hair 26 has a predetermined weft width that may be the same as or less than the length of bottom edge 28. The weft of hair 26 has a length, texture and color that is suitable for its intended use. In some embodiments, the weft seam 24*a,b* and weft of hair 26 are intermingled as a single layer (not specifically shown). Additionally, the weft seam 24*a,b* is not required to have the same length as the length of a side edge 29 of the base 16. The length of the weft seam may be less than or equal to the length of the side edge 29.

In yet other embodiments, the weft seam 24*a,b* may not be present, but instead replaced by the adhesive layer 22. In this configuration, the adhesive layer 22 is configured to operate as both the hair weft seam and to adhere the weft of hair 26 to the bottom surface of the base 16. This embodiment provides a slightly thinner hair extension device than some of the other embodiments because fewer layers of material are stacked on the bottom side of the base 16.

Still referring to FIG. 1, another adhesive 30 may be distributed behind the first hair weft 26 (and in some embodiments, seam 24*b*). Adhesive 30 may be of the same adhesive material as the adhesive 22. The adhesive 30 is used to hold a second weft of hair 34 and its associated seam 32*a* (and in some embodiments also seam 32*b*) firmly in place behind the plurality of layers discussed above. The seam 32*a,b* may be a stitched, taped, adhesive or an ultrasonic welded seam that holds the strands of the second weft of hair 34 in place and may have similar or identical construction as the first weft of hair 26 and seam 24*a,b*.

Figure 2:
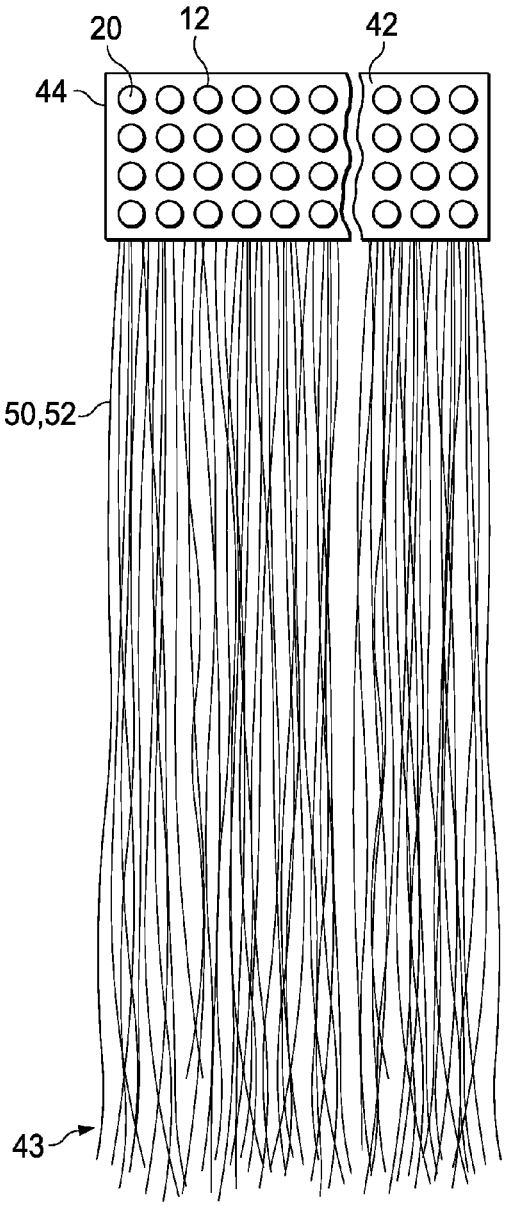
FIG. 2 is a front view of a hair extension device in accordance with an embodiment of the invention.
Figure 3:
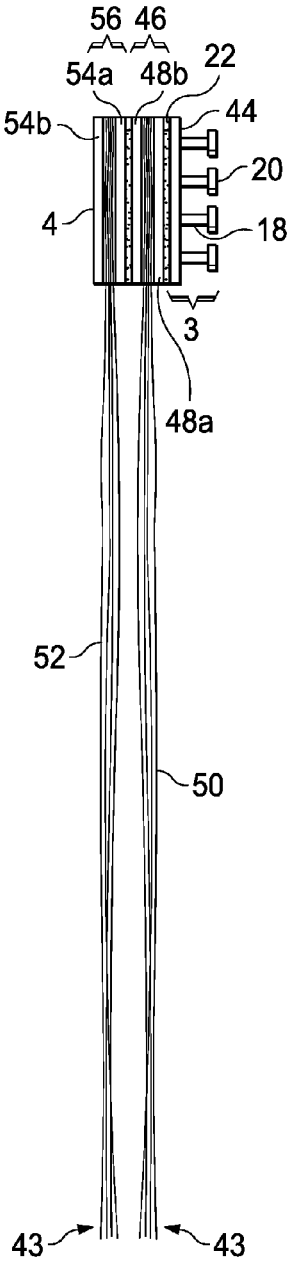
FIG. 3 is a side view of a hair extension device in accordance with an embodiment of the invention.

Referring to FIG. 2 and FIG. 3, a front and side edge view of another hair extension device 40 in accordance with an embodiment of the invention are shown, respectively. In this embodiment, there is an attachment portion 3 configured to attach the embodiment to a wearer's hair and a weft portion 4 comprising one or more wefts of filaments attached to the back side of the attachment portion. In this embodiment, the headed studs 12 are organized in an array of rows and columns on the front surface 41 of a resilient base 44. In yet other embodiments, the headed studs 12 may be in a variety of array patterns that are configured to allow strands of hair on the user's head to move between the head portions of the headed studs 12 and become wrapped, entwined and entangled about a plurality of the headed stud stem portions.

Under the back surface of the base 44 an adhesive 22 is used to hold a first hair weft 46 in place. The first hair weft 46 may include a seam 48*a* (and in some embodiments also 48*b*) and a weft of hair 50. The seam 48 may be a stitched seam, a taped seam, an ultrasonic welded seam, or an adhesive seam. The weft of hair 50 is held in place by the seam 48*a,b*.

In some embodiments the seam 48 is not present. Instead the adhesive 22 is utilized as both the seam and the adhesive to keep the first weft of hair 50 attached to the back side of the base 44 and act as the seam for hair weft 46.

In some embodiments, a second adhesive 30 is distributed behind the first hair weft 46. The second adhesive 30 may be of the same material as the first adhesive 22. The second adhesive 30 is configured to firmly attach a second weft of hair 52 and seam 54*a,b* (the combination of which is referred to as the second hair weft 56) to the back side or behind the first hair weft 46. The first weft of hair 50 and the second weft of hair 52 have proximate hair weft ends under the base 44 and distal hair weft ends 43 a suitable distance from their respective seams in accordance with the hair extension's intended use.

Thus, the embodiment shown in FIGS. 1 and 2 has two stacked hair wefts 46 and 56 behind the base 44. Other embodiments may have only a single hair weft (i.e. hair weft 46), while other embodiments may have more than two and perhaps up to six hair wefts stacked behind the base 44.

The combination of the headed studs 12, the resilient base 16, the adhesives, wefts of hair and seams remain flexible and resilient.

In yet other embodiments of the invention, when synthetic hair filaments are used to make the wefts of hair. The wefts of hair may be ultrasonic welded together and directly to the bottom of the base 44 without the addition of adhesive; although an adhesive or a protective layer may be used to cover the back side of the ultrasonic welded wefts so as to protect the ultrasonic welded seam and filaments from being frayed during installation and while worn by the user.

FIGS. 4A, 4B, 4C, and 4D illustrate side and top views of various headed studs that may be incorporated into embodiments of the hair extension device. In all illustrations, the headed studs 60*a, b, c* and *d* have respective stem portions 62*a, b, c* and *d*; and respective head portions 64*a, b, c* and *d*. The stem portions 62 may extend perpendicular or near perpendicular to the top surface of the base a distance or length L of about 2 to 6 mm and have a cross sectional diameter or width W of about 0.5 to 1.5 mm. The head portions 64 of the headed studs 60 may each have height H of about 0.5 to 1.2 mm with a widest cross sectional width or diameter D of between about 1 and 4 mm. The top surface 66*a, b, c* and *d* of the each of the head portions may be dome shaped or flat. The bottom surface 68*a, b, c* and *d* of each of the head portions may be flat, slanted or curved. The spacing between the outer edges of the head portions 64 should be between about 1 mm to about 3 mm to allow the wearer's hair to move between the headed studs when embodiments are being installed on a wearer's head.

It has been determined that in some circumstances longer length stem portions attach, latch onto and/or grip kinky hair filaments more easily with the Felini grip, while shorter length stem portions may be better suited to attach, latch onto and/or grip both kinky hair and straighter hair filament types more easily with the Felini grip. In some embodiments it may be advantageous to have a staggering of two or three different length headed stud portions extending from the front surface of the base.

Figure 4A:
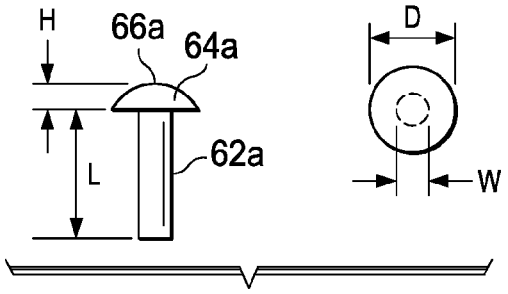
FIGS. 4A, 4B, 4C, and 4D illustrate top and side views of various headed studs that may be incorporated as part of various embodiments of the invention.
Figure 4B:
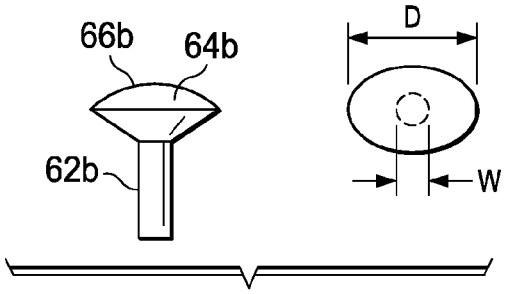
Figure 4C:
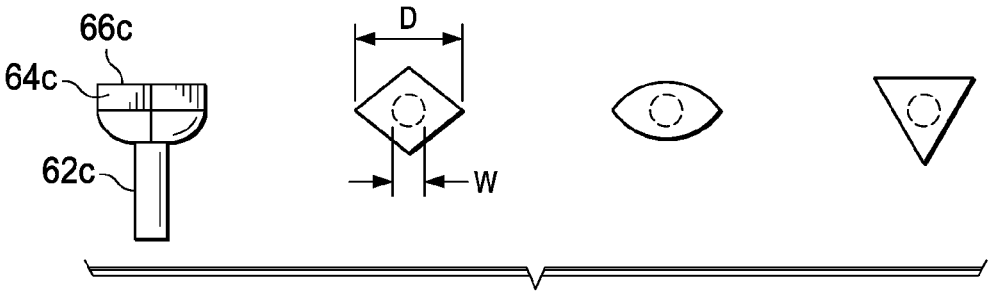
Figure 4D:
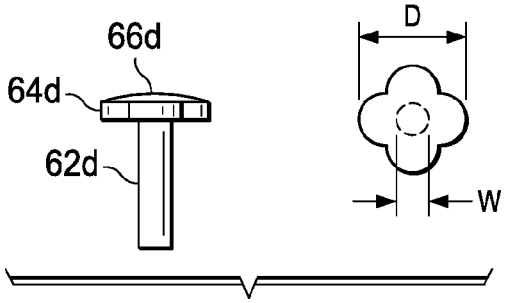

FIG. 4A illustrates a headed stud 60*a* with a circular head portion 64*a* having a domed upper surface 66*a* and a flat lower surface 68*a*. FIG. 4B illustrates a headed stud 60*b* with an oval head portion 64*b* having a domed upper surface 66*b* and a sloped or slanted lower surface 68*b* that slanted or sloped proximately from a peripheral edge of the head portion and back toward the stem portion. FIG. 4C illustrates a headed stud 60*c* with one of a diamond shaped, an eye shaped or a triangular shaped head portion 64C with a flat top surface 66*c* and a concavely curved lower surface 68*c*. FIG. 4D illustrates a headed stud 60*d* with a clover or irregular shaped head portion with a domed top surface 66*d* and a flat lower surface 68*d*. Various combinations and permutations of the upper and lower head surfaces in the embodiments. It was found that use of non-circular head portions often increases the ability and ease of embodiments being attached and staying attached and stationary in a wearer's hair for a week or more with the Felini grip about the headed studs holding it in place. Additionally, slanted, sloping, angled, concave and convex (not specifically shown) lower surfaces 68 are advantageous for easier removal of embodiments from a wearer's hair when the Felini grip is loose.

Figure 5:
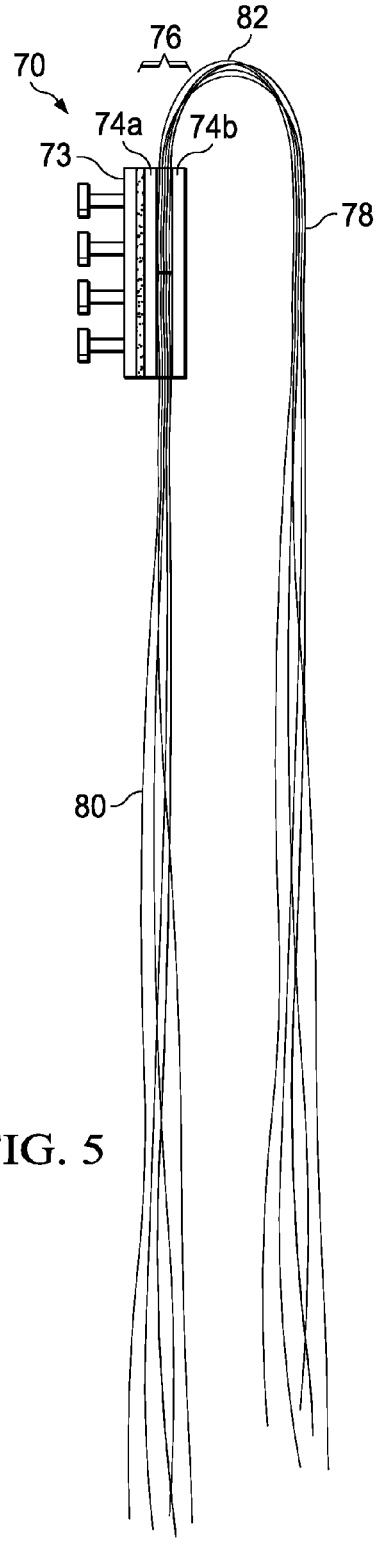
FIG. 5 is a side view of another hair extension device having one or more wefts of hair with centrally positioned seam(s) behind the a base and headed studs of an attachment portion of the hair extension device in accordance with embodiments of the invention.

FIG. 5 depicts another embodiment of a hair extension device 70 in accordance with embodiments of the invention. This embodiment 70 is similar to the previous described embodiments with a significant difference. Here in order to increase the amount of volume that the hair extension device can add to a user's hair style, the weft of hair 71 has a seam 74*a* (and in some embodiments also 74*b*) centrally located in the weft of hair 72. In other words, the weft of hair 76 has its seam centrally located between the two ends of the weft of hair 72. The weft of hair 72 is thus divided into an upper weft portion 78 and a lower weft portion 80. In another embodiment two wefts of hair are used such that they are overlapped or positioned proximate to being end-to-end and behind the base 73. These embodiments are configured such that when the hair extension device is installed in a person's hair style, the upper weft portion of hair 78 arcs or is pre-folded, curled or textured 82 to change directions from extending in a general upward direction to a downward direction such that the fold, curved curl or texture 82 add additional volume or lift to the overall hair style from underneath the natural existing hair of the wearer that is styled over and covering the hair extension device 70.

FIG. 5 depicts a single hair weft 70 having a centrally located weft seam 74*a,b*. It is understood that additional hair wefts can be stacked such that extend upward and/or downward in back the first hair weft 76 to increase the amount of effect or volume effect created by the embodiments.

Figure 6:
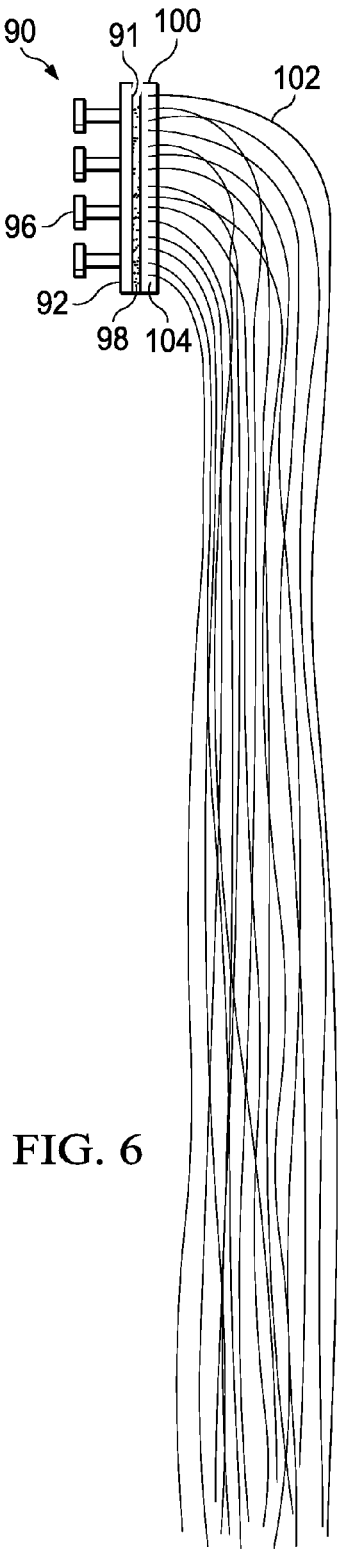
FIG. 6 is a side view of another hair extension device having a follicle style weft in accordance with an embodiment of the invention.

FIG. 6 is a side view of yet another embodiment of a hair extension device 90 in accordance with the invention. This embodiment incorporates what is often referred to in the art as a follicle or skin hair weft, wherein the direction of the hair in the weft will not be necessarily parallel with the back surface 91 (or front surface 92) of the resilient base 94. Like the other embodiments, there is a plurality of headed studs 96 that extend perpendicular from the front surface 92. An adhesive 98 is distributed on the bottom surface of the base 94 to hold one or more follicle hair wefts 100 in place. In this embodiment, the follicle hair weft 100 comprises a weft of hair 102 that extends initially from about 2 to about 90 degrees or perpendicular to the bottom surface the base 94. The weft of hair is held together by a seam 104. In some embodiments a plurality of follicle type hair wefts 100 may be aligned next to each other in a parallel or spaced-parallel manner and adhered to the bottom surface of the base 94 such that each of the follicle hair wefts are angled at a same angle with respect to the bottom surface of the base 94 in order to create hair extension hair styles that add additional volume and lift to a wearer's existing hair. The angle of the follicle hair wefts (or in some embodiments glued or taped hair wefts) may be between about 2° to 90° with respect to the bottom surface 91 of the base 94.

Figure 7:
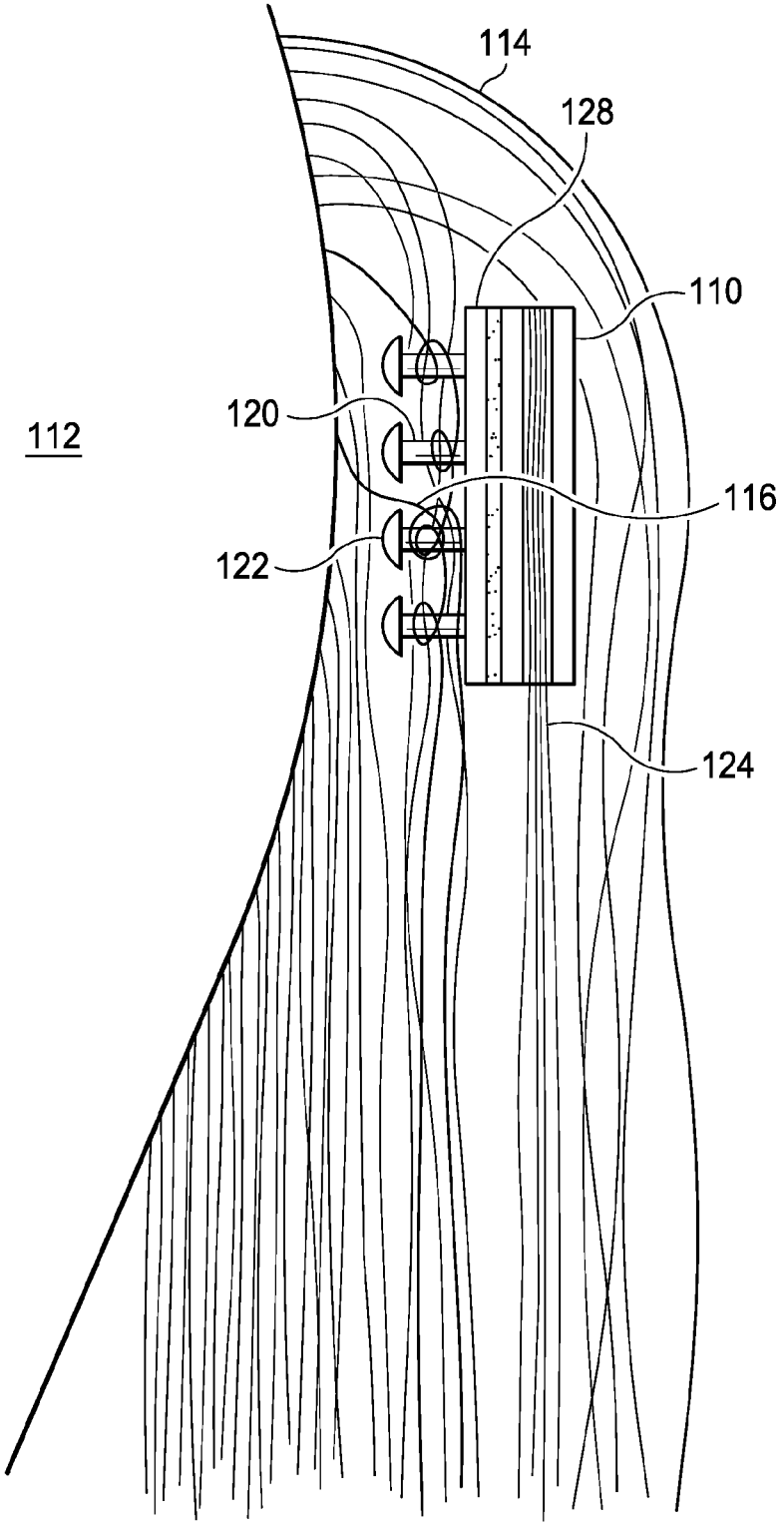
FIG. 7 is an illustration of a hair extension device installed in the hair of a user with a Felini grip.

FIG. 7 is an illustration of a hair extension device 110 having a hair weft 124 adhered or secured to the bottom surface 126 of the base 128 and is installed in the hair 114 on a person's head 112 with the Felini grip 116. The inventor refers to the Felini grip 116 as the entwined and entangled random, non-woven wrapping of the wearer's hair strands about the headed studs of the hair extension device 110 when installed in the wearer's hair 114. It is unclear exactly why hair wraps, entangles and entwines about the headed studs to grip and hold embodiments so securely, but the inventor believes that the reason may be somewhat similar to that of what the inventor refers to as a non-woven randomized Kellems grip, which the inventor has named the Felini grip 116. That is, after the hair has been sufficiently wrapped, entangled and randomly entwined about the headed studs, and an embodiment of the hair extension device is tugged gently by the weft or wefts of hair, the wearer's hair tightens and grips the stem portions 120. Additionally, because of the wrapping and random entwinement about the stem portions 120, the hair does not slip off the head portions 122 of the headed studs 118. Thus, embodiments of the hair extension device 110 are securely held in place. In some methods of installing embodiments of the hair extension devices, the headed studs 118 and top surface of the base may be sprayed or otherwise coated with a hair adhesive to aid the Felini grip and help hold the hair extension device in place. Some hair adhesives that may be used for this purpose include, but are not limited to, hair spray, hair gel, hair adhesive power, hair adhesive gum, hair conditioner, and other suitable hair products available in the hair care industry.

Conversely, to remove embodiments of the hair extension device 110 from a wearer's hair, the hair extension device is gently pushed opposite to the hair growth direction and in the direction of the wearer's scalp to loosen the Fellini grip about the stem portions, then it is gently peeled away from the scalp and hair so the loosened Fellini grip allows the loosened wrappings and entwinements to slip over the head portions of the headed studs.

Figure 8:
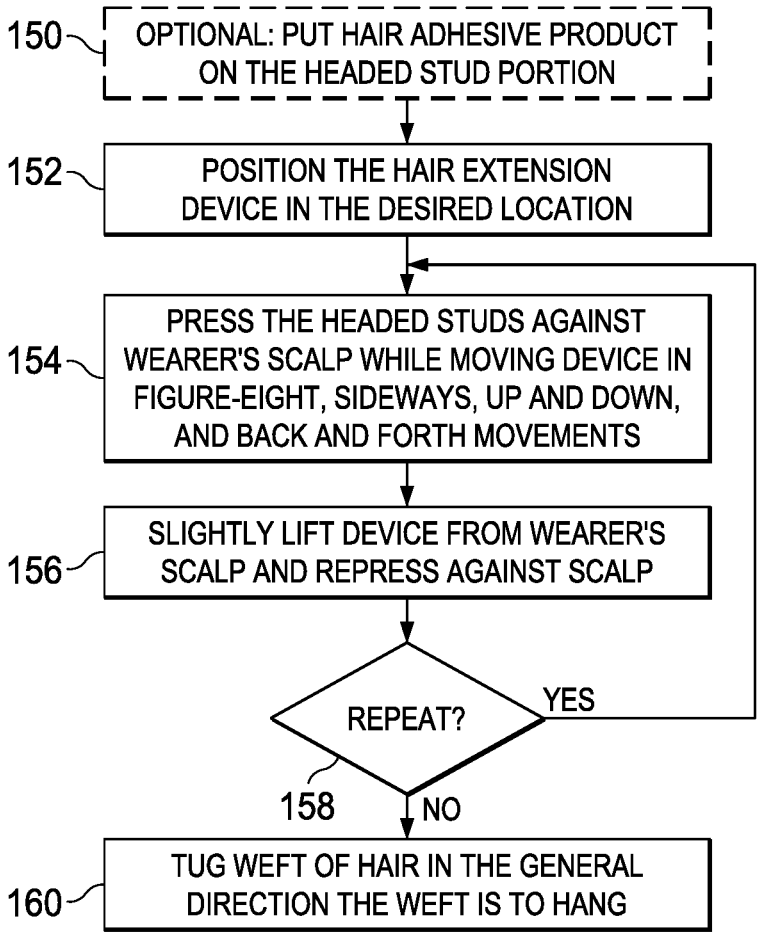
FIG. 8 is a flow chart showing a method of installing a hair extension device in a wearer's hair in accordance with the invention.

FIG. 8 is a flow chart showing a method of installing a hair extension device in a wearer's hair in accordance with the invention. The wearer's hair is prepared, brushed and parted in a manner similar to a method of installing taped wefts hair extensions that is well known in the art. The initial step 150 of this method of installing a hair extension device embodiment is an optional step. At step 150 it is optional to spray, brush or otherwise put a hair adhesive product onto the headed studs and the top side surface of the base. The hair adhesive product may be any of a variety of hair fixant products commonly used to hold hair in place, such as hair spray, hair gel, hair adhesive powder, hair adhesive gum, hair conditioner or other hair treatment products.

At step 152, the hair extension device is positioned with the headed studs (i.e., the top side of the base) facing the wearer's head and scalp in the desired location. The desired location being a parted portion of hair next to the scalp of the wearer as is normally and generally done when installing taped weft hair extensions.

At step 154, the hair extension device is pressed against the wearer's scalp such that hair strands are forced between the headed studs. This is done while repeatedly moving the device in many small figure eights, sideways, up and down, and back and forth movements. Such movements are generally between about 1 mm and about 1 cm movements in any direction at a time.

At step 156, the hair extension device is lifted slightly (e.g., about 2 to about 5 mm) off the scalp and then repressed against the scalp of the wearer. This is done in order to allow additional hair strands or filaments to be pushed between the spaced head portions and the top surface of the base, as well as to push some lengths of already incorporated hair strands or filaments back between different spaced head portions.

At step 158, the steps of 154 and 156 are repeated multiple times. The number of times these steps are repeated depends on the wearer's hair type, be it very curly kinky, wavy, straight, thick, or thin; and on the length of time that the hair extension device is expected to remain installed in the wearer's hear. Repeating steps 154 and 156 establishes a basis for a randomized or non-woven Kellems grip, which the inventor has named, the Felini grip, wherein in this situation the wearer's hair strands and filaments are wrapped, entangled and entwined randomly about a plurality of the headed studs such that they tighten and grip the headed studs when the weft of hair is tugged or gently pulled.

At step 160, the weft of hair is tugged in the direction it will ultimately hang. The tug tightens the Felini grip and locks the wearer's hair strands about the plurality of headed studs so that the hair extension device does not come loose. Upon completion of this step 160 embodiments are secured in place on the wearer's head and can, in various embodiments, remain secured in place for multiple weeks. Yet, embodiments are easily removed from the wearer's hair by moving the device in a direction opposite to the hair growth direction and toward the wearer's scalp to loosen the Felini grip. Then the extension device is gently peeled, starting from a side edge of the base and toward the other side edge out of the wearer's hair. Thus, if an adjustment to the placement of the extension device is required, such adjustment is easily made without having to use a new and different hair weft or hair extension device. Additionally, the same extension device can be reused and reinstalled again and again, which is an advantage over similar prior hair extension techniques, such as taping, which are only installable once and wherein a new hair weft has to be color and texture matched prior to installation in order to properly make the adjustment or repair to the wearer's extension hair style.

It will be appreciated by those skilled in the art having the benefit of this disclosure that this hair extension device provides a secure hair extension attachment to a wearer's head while being easily installed and removed in a timely manner. Additionally, such hair extensions can be reused and/or readjusted after being installed. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the scope and content hereof, as defined by the following claims. Thus, it is intended that the following claims be interpreted to embrace all such further modifications, changes, rearrangements, substitutions, alternatives, design choices, and embodiments.

What is claimed is:

1. A method of installing a hair extension device comprising an attachment portion having a base having a back surface and a front surface; and a plurality of upstanding headed studs spaced apart from each other in an array and distributed across the front surface of the base; and a weft portion comprising a weft of filaments attached proximate to a first end of the weft of filaments to the back surface of the base, the method comprising:

positioning the front surface of the hair extension device over a desired hair and scalp location;

pressing the headed studs against the scalp location while moving the attachment portion in a combination of figure-eight, back and forth, and up and down movements;

lifting the headed studs from the scalp surface between 1 mm and 10 mm and repressing the headed studs back against the desired hair and scalp location; and tugging the weft of filaments in a general direction that the weft of filaments is intended to hang.

2. The method of claim 1, further comprising applying a hair adhesive to the headed studs prior to pressing.

3. The method of claim 1, further comprising repeating pressing and lifting a plurality of times prior to tugging.

* * * * *